US005390905A

United States Patent [19]

Melchior

[11] Patent Number: 5,390,905

[45] Date of Patent: Feb. 21, 1995

[54] APPARATUS FOR CUTTING AND BINDING MULTI-LAYERED PRINTED PRODUCTS

[75] Inventor: Wolfgang Melchior, Hessheim, Germany

[73] Assignee: Albert-Frankenthal Aktiengesellschaft, Wurzburg, Germany

[21] Appl. No.: 110,171

[22] Filed: Aug. 23, 1993

[30] Foreign Application Priority Data

Aug. 22, 1992 [DE] Germany ..... 4227930

[51] Int. Cl.[6] ..... B41F 13/56; B27F 7/17

[52] U.S. Cl. ..... 270/21.1; 270/37; 227/81; 227/76

[58] Field of Search ..... 270/21.1, 37, 20.1, 270/6; 227/81, 76

[56] References Cited

U.S. PATENT DOCUMENTS 945,507 1/1910 Firm ..... 270/37
2,364,504 12/1944 Zuckerman ..... 227/81
4,210,268 7/1980 Fischer .

FOREIGN PATENT DOCUMENTS 0005767 12/1979 European Pat. Off. .
0515945A1 12/1992 European Pat. Off. .
754924 7/1954 Germany ..... 227/81
2932756 3/1982 Germany .
2932757 3/1982 Germany .

*Primary Examiner*—Edward K. Look
*Assistant Examiner*—John Ryznic
*Attorney, Agent, or Firm*—Jones, Tullar & Cooper

[57] ABSTRACT

A multi-layered printed product is cross cut and stapled by being fed past a gripping and folding blade cylinder and cooperating binding and cutting cylinders. The binding and cutting cylinders have parallel but offset axes of rotation and define envelopes of rotation which intersect each other at a point which is before, in the direction of travel of the printed product, the point at which the binding and cutting cylinders cooperate with the gripping and folding blade cylinder.

6 Claims, 2 Drawing Sheets

D
d
b
II
II

APPARATUS FOR CUTTING AND BINDING MULTI-LAYERED PRINTED PRODUCTS

FIELD OF THE INVENTION

The present invention is directed generally to an apparatus for cutting and binding multi-layered printed products. More particularly, the present invention is directed to an apparatus for cutting and binding multi-layered printed products in a folding apparatus. Most specifically, the present invention is directed to an apparatus for cutting and binding multi-layered printed products in a folding apparatus by using printed product cutters and wire binding or staple forming devices. The product cutters and the wire staple forming and inserting devices are supported on separate shafts which are parallel to each other but are spaced from each other. Both the cutting and wire binding devices cooperate with a folding blade and wire pointing cylinder so that the printed products will be cut and bound or stapled by the two sequentially acting devices.

DESCRIPTION OF THE PRIOR ART

It is generally known in the art to provide binding or stapling devices for use with printed products that are also to be cut by a cutting blade cylinder. One such binding device for use in printing presses which is combined with a cutting cylinder, and is hereinafter called a binding cylinder, is shown in German Patent Publication DE 29 32 757 C2.

In this prior art device, hinged squares with gripping devices are located within the binding cylinder and project out beyond the periphery of the binding cylinder in order to receive wire pieces. These wire pieces, which will be formed into staples, have previously been cut to the desired length by a cutting device. As the binding cylinder continues to rotate, a tongue, which acts as a male die member, moves in a rapid downward movement in the direction of the cylinder interior. A plate is used as the bottom die. After a further movement of the binding cylinder has taken place, the staples which were formed in this manner are brought to the periphery of the binding cylinder and are pushed through the product. Once these staples have been pushed through the product, they are closed by being pushed against the collecting cylinder which is acting as a stop.

One limitation of this prior art device is that it is necessary to actuate tongues or grippers, which are outside the periphery of the binding cylinder, from the direction of the binding cylinder for taking the wire pieces out of the wire cutting device. This is because there must be a space between the wire feed device and the staple former to accommodate the circular envelope or path of the cutters which are also rotating. The centrifugal force generated in the course of this action limits the rotational speed of the binding cylinder. This limit on the rotational speed of the binding cylinder, in turn, limits the production speed of the printing press with which the binding cylinder is associated.

It will thus be apparent that a need exists for a cutting and binding apparatus which overcomes the limitation of the prior art devices. The apparatus for cutting and binding multi-layered printed products in accordance with the present invention provides such a device and is a significant improvement over the prior art devices.

SUMMARY OF THE INVENTION

It is an object of the present invention to provide an apparatus for cutting and binding multi-layered printed products.

Another object of the present invention is to provide an apparatus for cutting and binding multi-layered printed products in a folding apparatus.

A further object of the present invention is to provide an apparatus for cutting and binding or stapling multi-layered printed products by using printed product cutters and wire binding devices.

Yet another object of the present invention is to provide an apparatus for cutting and binding multi-layered printed products in which the bottom die of the cutting device is a rigid assembly.

Still a further object of the present invention is to provide an apparatus for cutting and binding multi-layered printed products which is operable at higher production speeds.

As will be discussed in detail in the description of the preferred embodiment which is set forth subsequently, the apparatus for cutting and binding multi-layer printed products in accordance with the present invention utilizes a pointing and folding blade cylinder in conjunction with rotating cutter bars and wire stapling and inserting heads to cut and bind or staple the products. The cutter bars are supported on a cutting cylinder which has a first axis of rotation. The binding heads are supported on a binding head cylinder that has a second axis of rotation. These two axes of rotation of the cutting cylinder and of the binding head cylinder are parallel to each other and are spaced from each other with respect to the axis of rotation of the pointing and folding blade cylinder. The cutting cylinder and the binding head cylinder thus form two separate envelopes or circles of rotation as they rotate about their respective axes. These two circles of rotation intersect just before, in the direction of paper feed, a point where they contact the pointing and folding blade cylinder. At all other points, other than at 180° from this first point of intersection, these two envelopes are not coextensive. This allows the binding cylinder to be fed with wire segments which are then formed into staples, without interfering with the rotational path of the cutting cylinder.

A primary advantage of the apparatus for cutting and binding multi-layered printed products in accordance with the present invention is that no parts of the binding cylinder project out past the periphery of the binding cylinder. This allows the binding cylinder to receive its wire segments and to form them into staples while still ensuring that the binding cylinder and the cutting cylinder can intersect in their envelopes of rotation adjacent the point where they engage the pointing and folding blade cylinder. The fixed cutters on the cutting cylinder are placed at the periphery of that cylinder. Since the axes of the binding cylinder and the cutting cylinder are parallel but spaced from each other, the cutting cylinder can rotate through an envelope of rotation which keeps the fixed cutters out of contact with the wire feeding devices that are used to feed the wire to the binding devices.

The apparatus for cutting and binding multi-layer printed products in accordance with the present invention overcomes the limitation of the prior art devices. It is a substantial advance in the art.

BRIEF DESCRIPTION OF THE DRAWINGS

While the novel features of the apparatus for cutting and binding multi-layered printed products in accordance with the present invention are set forth with specificity in the appended claims, a full and complete understanding of this invention may be had by referring to the detailed description of the preferred embodiment which is set forth subsequently, and as illustrated in the accompanying drawings, in which:

DESCRIPTION OF THE PREFERRED EMBODIMENT

Figure 1:
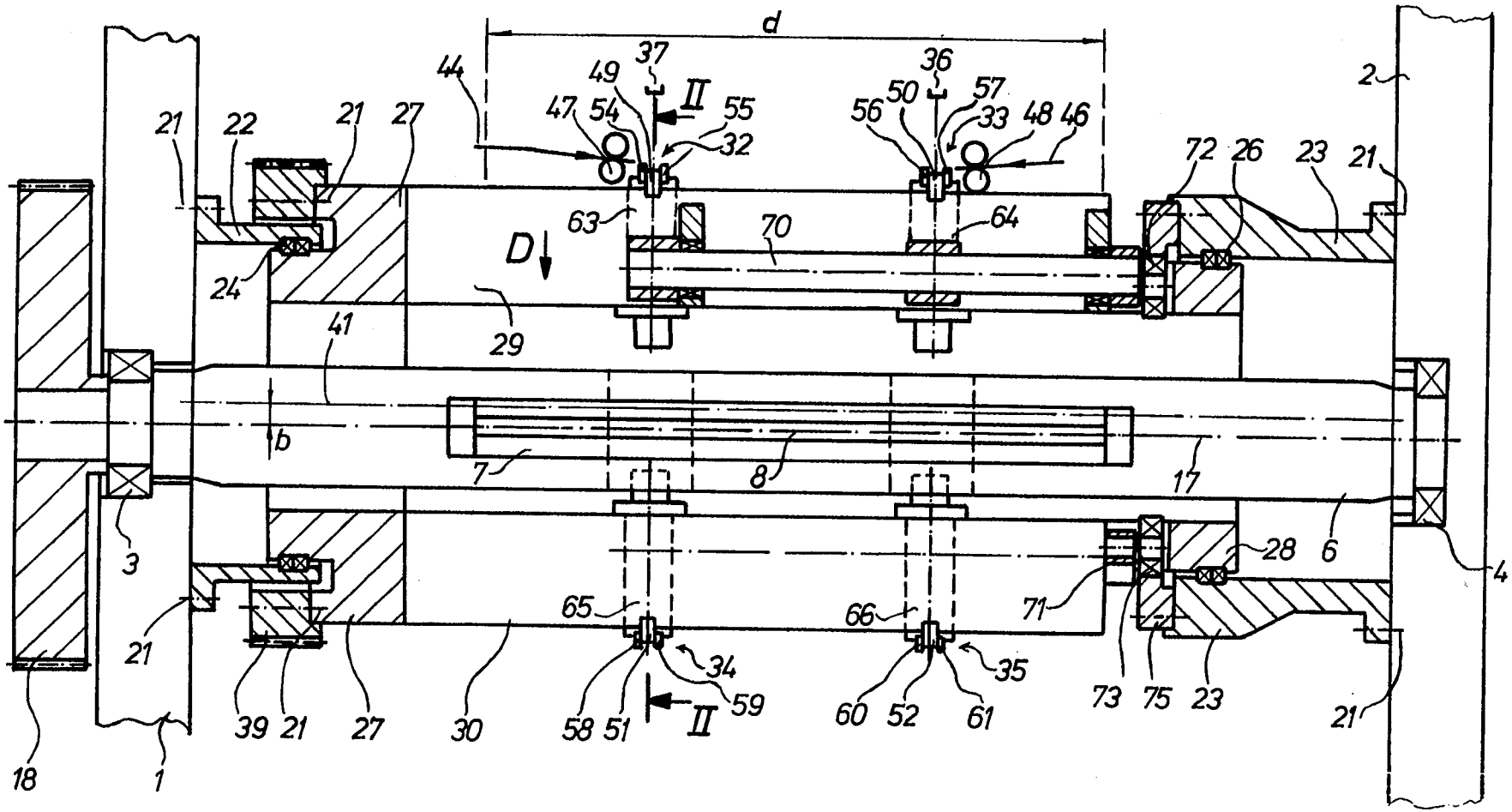
FIG. 1 is a front plan view, partly in section, of an apparatus for cutting and binding multi-layered printed products in accordance with the present invention.

Referring initially to FIG. 1, there may be seen a preferred embodiment of an apparatus for cutting and binding or stapling multi-layered printed products in accordance with the present invention. A cutting cylinder shaft, generally at 6, is rotatably supported between spaced side frames 1 and 2 of the printing machine by suitable bearings 3 and 4. This cutting cylinder shaft 6 carries a generally cuboid base body 7. This base body 7 is secured to the cutting cylinder shaft 6 in such a way that it is dynamically balanced in the longitudinal direction of shaft 6. In other words, shaft 6 with its attached base body 7 will rotate smoothly and without vibration about the axis of rotation of the shaft 6. If desired, the shaft 6 and the base body 7 can be made as one element.

Figure 2:
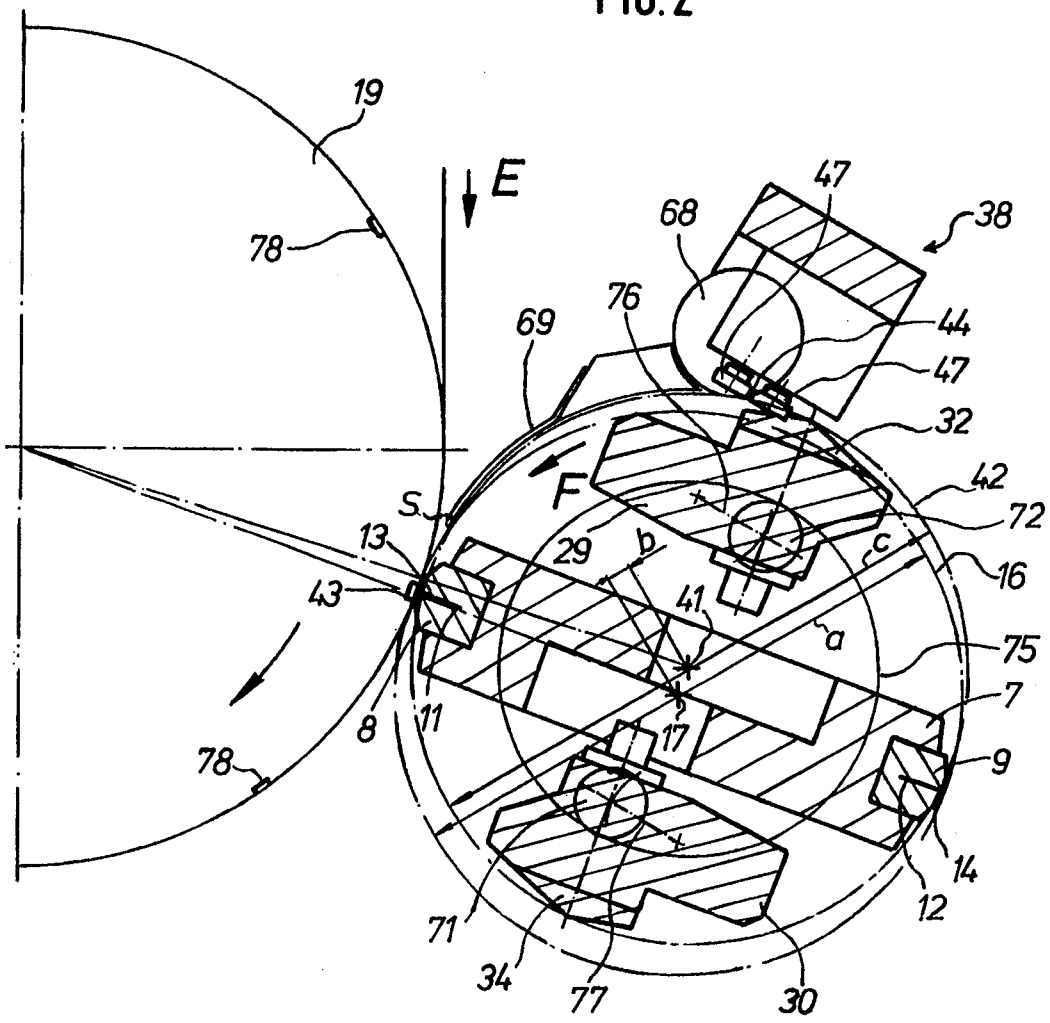
FIG. 2 is a cross-sectional view of the apparatus of FIG. 1 and taken along line II—II of FIG. 1.

As may be seen by also referring to FIG. 2 of the drawings, cutter bars 8 and 9 are secured to diametrically opposing edges of the base body 7. These cutter bars 8 and 9 are thus placed in the outer periphery of the base body 7. As seen more clearly in FIG. 2, each of the cutter bars 8 and 9 is provided with a cutter 11 and 12, respectively, with each such cutter 11 and 12 having a cutting edge 13 and 14, respectively. These cutting edges 13 and 14 circumscribe a first circular envelope 16 which will be referred to as the cutting bar cylinder or cutting cylinder envelope 16. This cutting cylinder envelope 16 has a diameter "a" which, as seen in FIG. 2, extends through the axis of rotation 17 of the cutting cylinder shaft 6. At one point, this envelope 16 of the cutting cylinder is in contact with the surface of a pointing and folding blade cylinder, generally at 19, as may be seen in FIG. 2.

The cutting cylinder shaft 6 is driven by rotation of a toothed drive wheel 18 that is secured to one end of shaft 6 exterior of the side frame 1, as seen in FIG. 1. This drive wheel 18 is, in turn, driven by a drive for the pointing and folding blade cylinder 19 in a manner which is not specifically shown in the drawings. The pointing and folding blade cylinder 19 is generally conventional. It could be provided with sheet grippers instead of the sheet gripping points so that it could also be referred to as a gripping and folding blade cylinder.

Turning again initially to FIG. 1, a pair of generally tubular or pipe-shaped bearing supports 22 and 23 are secured to inner surfaces of the side frames 1 and 2 by rotatable screws or other suitable fastening means which are depicted schematically at 21. Annular support bodies 27 and 28 are rotatably supported in the bearing supports 22 and 23, respectively, by bearings 24 and 26, which are preferably embodied as thin, annular bearings. The two annular support bodies 27 and 28 are connected by axially extending and diametrically opposed support sections or beams 29 and 30. These support beams 29 and 30, together with their associated annular support bodies 27 and 28, form a binding cylinder which rotates about a binding cylinder axis 41. The support beams 29 and 30 are dynamically balanced with the support bodies 27 and 28 so that the binding cylinder will rotate about its axis of rotation 41 in a smooth, vibration free manner.

A pair of generally known binder or staple heads 32 and 33 are secured on the support beam 29 while similar binder or staple heads 34 and 35 are secured by the support beam 30. These binder heads 32–35 are usable to form wire staples 36 and 37, as may be seen in FIG. 1. Each of these binding heads cooperates with wire feed devices that are used to feed the staple wire to the binding heads. These wire feed devices are attached to the press frame adjacent the binding heads, as may be seen in FIG. 2. Only one such wire feeding device will be depicted and discussed; however, it will be understood that each of the binder heads 32 and 33 will have a wire feed device associated with it. The support bodies 27 and 28, together with the support beams 29 and 30, which make up the binder cylinder, are caused to rotate by a toothed wheel 39. This toothed wheel 39 is secured by suitable screws 21 or the like to the support body 27 radially exterior of the bearing support 22. The toothed wheel 39 is, in turn, driven by the drive of the folding blade cylinder 19 in a manner which is not specifically shown in the drawings.

Again referring initially to FIG. 1, the bearing supports 22 and 23 for the support bodies 27 and 28 are secured to the spaced side frames 1 and 2 of the machine so that the axis of rotation 41 of the binding cylinder, which is defined by the support bodies 27 and 28 together with the support beams 29 and 30, and which supports the binding or stapling devices 32–35, is positioned at a distance "b" from the axis of rotation 17 of the cutting cylinder which is defined by the shaft 6, the base body 7, and the cutting bars 8 and 9. As may be seen in FIG. 2, the circular envelope 42 defined by the rotational path of the binding cylinder has a diameter "c" such that the binder heads 32–35 pass by the wire feed device 38, whose function will be discussed shortly. It will also be seen in FIG. 2 that the envelope 42 of the binding cylinder and the envelope 16 of the cutting cylinder intersect at a point S which is before, in the direction E of paper travel, where the two cylinders 42 and 16 are adjacent to the peripheral surface of the pointing and folding blade cylinder 19 and at a point 180° diametrically opposite. This point of intersection S of the cutting cylinder and the binding cylinder before the pointing and folding blade cylinder 19 insures that as the cutting and binding cylinders are caused to rotate by their respective drive wheels or gears 18 and 19 that the cutting edges 13 and 14 of the cutters 11 and 12, which extend along the entire length "d" of the cutting bars 8 and 9, will always engage the pointing and folding blade cylinder 19 and that the staples carried by the binding cylinder will be inserted into the printed product before the product passes by the cylinder 19. The multi-layered printed products are fed into the nip or space between the cylinders, in the direction indicated by the arrow E in FIG. 2. The cutting position of a multi-layered printed product between the cutting edge 13 of the cutter 11 and a cooperating cutting bar 43 on the circumference of the pointing and folding blade cylinder 19 is shown in FIG. 2. It will be noted that the binder or stapling heads 32 and 33 on the support beam 29 of the binding cylinder are passing by the wire feed device 38 so that suitable wire staples 36 and 37 will be formed and can be inserted into the multi-layer printed product after the binder cylinder has rotated through generally another 90°. Thus each cutting blade and each binder head are generally 90° out of phase. This allows the multi-layer printed product to be alternately cross cut by the cutter cylinder and stapled by the binder cylinder as each of these cylinders cooperates with the pointing or gripping and folding blade cylinder 19.

The operation of the staple forming and inserting portion of the present invention will now be described in detail. As is depicted in a somewhat schematic manner in FIG. 1, lengths of wire 44 and 46, from rolls of wire which are not specifically shown in the drawings, are fed to the binder heads 32 and 33 by pairs of transport rollers 47 and 48. See German Patent DE-PS 11 89 562 in this respect. The binder heads 32 to 35, respectively, each have fixed dies 49 to 52. Guides 54 to 61 are disposed on both sides next to the dies 49 to 52 and are connected with binder pistons 63 to 66. The guides 54 to 61 can be moved in the radial direction together with the dies 49 to 52. After the wire 44 and 46 has been conveyed by the pairs of transport rollers 47 and 48 over the guides 54 to 57 to binder heads 32 and 33 through wire inlet and cutting nozzles disposed in a socket pin, not shown, bending rollers 68 are used, as shown in FIG. 2, to form the fed-in wire 44 or 46 into staples 36 or 37. In the course of this, the bending rollers 68 press the wire 44 or 46, resting on the guides 54 to 57, between the guides 54 to 57 down as far as the dies 49 or 50, so that staples 36 and 37 are formed. For this purpose the guides 54 to 61 also have longitudinal grooves extending in the radial direction.

As the apparatus for cutting and binding multi-layered printed products in accordance with the present invention continues to rotate in the direction indicated by the arrow F in FIG. 2, the upwardly oriented legs of the staples 36 and 37 come into engagement with guide tongues extending in the direction of rotation F and fixed on the frame. These guide tongues, which are illustrated in FIG. 2 and are indicated by 69, extend between the legs of the staples 36 and 37 and protect the staples 36 and 37 from the action of centrifugal forces.

After contact of the leg ends of the staples 36 and 37 with the product to be bound and their slight penetration into it, the staples 36 and 37 already have a hold in the product. At this time, the guides 54 to 57 disposed on the binding pistons 63 and 64 are retracted in the radial direction D by a movement of a control spindle 70 or 72, as seen in FIG. 1, so that no contact of the staple-forming members with the product takes place. This radial movement is performed by guide rollers 72 and 73 which move in a radial cam 75 fixed on the frame. The lever arms 76 and 77 of the guide rollers 72 and 73 are pressed against the radial cam 75 by restoring springs, not shown.

After the device has turned further in the direction F and the staples 36 and 37 have penetrated the product, the staple closing is performed by an appropriate stop 78 on the pointing and folding blade 19 by rolling the legs of the staples 36 and 37 toward each other. Because of the spacing "b" between the two axes of rotation 17 and 41, the cutting edge 14 of the cutter 12, which continues to move in the direction of rotation F toward the wire feed devices 38, passes beneath the wire feed devices 38, so that there is no contact between the cutting edge 14, or the cutting edge 13 which follows it in the direction of rotation F, with the wire feed devices 38.

The two other binder heads 34 and 35 disposed on the circumference of the device can be selectively shut off during a collecting operation. When twisting the binding device with respect to the cutting device, it is also possible to create an overlay fold or an underlay fold, depending on the direction of rotation. A prerequisite for this also is a corresponding readjustment of the folding blade gaps on the pointing and folding blade cylinder 19. In a departure from the exemplary embodiment shown, it is furthermore possible to dispose respectively three devices for cutting and binding in the device of the invention.

As has been discussed previously, the axis of rotation 41 of the binding cylinder is spaced at a distance "b" from the axis of rotation 17 of the cutting cylinder, as may be seen in both FIGS. 1 and 2. This distance or eccentricity of the two axes of rotation and hence of the cutting cylinder and the binder cylinder is preferably in the range of 10 to 50 mm. In the section view II—II shown in FIG. 2, the view is rotated through about 20° from that shown in this illustration. The location of the two axes of rotation 17 and 41 with respect to each other is selected so that both the cutting cylinder and the binding cylinder will intersect at the point S which is before, in the direction of travel E of the printed product, their points of engagement with the pointing and folding block cylinder 19 but will not be coincident at the wire feed device 38 so that the cutters 11 and 12 will not contact the wire feed device 38.

If the cutting and binding cylinders both have a counterclockwise direction of rotation, as seen in FIG. 2, and if the axis of rotation 41 of the binding cylinder is taken as the point of origin for a rectangular coordinate system, then the axis of rotation 17 of the cutting cylinder is in the III quadrant with the infeed of the multi-layered printed product, in the direction indicated by the arrow E in FIG. 2, being in the II quadrant. However, with a clockwise direction of rotation of the cutting cylinder and the binding cylinder, it is also possible that, referring to a rectangular coordinate system with the origin at the axis of rotation 41 of the binding cylinder, the axis of rotation 17 of the cutting cylinder can be in the IV quadrant if the paper feed E takes place in the I quadrant.

Again referring to FIG. 2, looking in the paper feed direction indicated by the arrow E, the intersection point S of the cutting cylinder's envelope 16 and the binding cylinder's envelope 42 is located outside of the pointing and folding blade cylinder 19 and ahead of the intersection point of a binding and cutting line. This binding and cutting line results from the operational connection of the binding or cutting cylinder with the pointing and folding blade cylinder 19. The binding and cutting line extends along in the axial direction of these cylinders. The cylinder envelope 42 of the binding cylinder partially extends within the circular envelope 16 of the cutting cylinder, as may be seen in the lower right portion of FIG. 2.

While a preferred embodiment of an apparatus for cutting and binding multi-layered printed products in accordance with the present invention has been set forth fully and completely herein above, it will be apparent to one of skill in the art that a number of changes in, for example, the overall size of the assembly, the type of support bearings used for the rotary shafts, the type of grippers on the gripping and folding blade cylinder and the like may be made without departing from the true spirit and scope of the present invention which is accordingly limited only by the following claims.

What is claimed is:

1. An apparatus for cutting and binding multi-layered printed products in a folding apparatus of a printing assembly, said apparatus comprising:

a gripping and folding blade cylinder adapted to receive a multi-layered printed product to be cut and bound;

a cutting cylinder having at least a first cutter and being rotatable about a cutting cylinder axis of rotation and defining a first circular envelope; and a binding cylinder having at least a first binder head and being rotatable about a binding cylinder axis of rotation and defining a second circular envelope, said cutting cylinder axis of rotation and said binding cylinder axis of rotation being parallel to each other and spaced from each other, said first and second circular envelopes intersecting each other adjacent said gripping and folding blade cylinder, and looked at in paper feed direction, before a binding and cutting line.

2. The apparatus of claim 1 further including a wire feed assembly usable to feed staple wire to said binder head and wherein said first circular envelope has no contact with said wire feed assembly whereby said first cutter has no contact with said wire feed assembly.

3. The apparatus of claim 1 wherein said cutting cylinder includes a cutting cylinder shaft and a generally cuboid base body secured to said cutting cylinder shaft, said at least first cutter being secured to a first outer edge of said base body.

4. The apparatus of claim 1 wherein said binding cylinder includes first and second axially spaced support bodies and at least first and second support beams extending between said support bodies, said first binder head being secured to one of said support beams.

5. The apparatus of claim 1 wherein said cutting cylinder axis of rotation and said binding cylinder axis of rotation are spaced from each other by a distance of between 10 and 50 mm.

6. The apparatus of claim 1 in which said cutting cylinder and said binding cylinder have counterclockwise directions of rotation and in which in a rectangular coordinate system whose origin is at said binding cylinder axis of rotation said cutting cylinder axis of rotation is located in quadrant III.

* * * * *